US010753146B1

(12) United States Patent
Andiarena

(10) Patent No.: US 10,753,146 B1
(45) Date of Patent: Aug. 25, 2020

(54) ADJUSTABLE BRACKET SYSTEM FOR A BOX SHADE ROLLER

(71) Applicant: Livan Montesino Andiarena, Hialeah, FL (US)

(72) Inventor: Livan Montesino Andiarena, Hialeah, FL (US)

( * ) Notice: Subject to any disclaimer, the term of this patent is extended or adjusted under 35 U.S.C. 154(b) by 0 days.

(21) Appl. No.: 16/844,293

(22) Filed: Apr. 9, 2020

(51) Int. Cl.
*A47H 1/14* (2006.01)
*E06B 9/42* (2006.01)

(52) U.S. Cl.
CPC ..... *E06B 9/42* (2013.01)

(58) Field of Classification Search
CPC ..... E06B 9/42; E06B 9/40; E06B 9/24; E06B 9/38
See application file for complete search history.

(56) References Cited

U.S. PATENT DOCUMENTS 2,894,710 A * 7/1959 Shields ..... A47H 1/124 248/265
3,730,469 A * 5/1973 Shields ..... A47H 1/12 248/265
7,854,419 B2 * 12/2010 Ng ..... E06B 9/50 160/323.1
9,206,641 B2 * 12/2015 Feldstein ..... E06B 9/50

* cited by examiner

*Primary Examiner* — Amy J. Sterling
(74) *Attorney, Agent, or Firm* — Ruben Alcoba, Esq.

(57) ABSTRACT

An adjustable bracket system that is used to secure a box shade roller to a fixed structure. The adjustable bracket system comprises of a pair of L-shaped bracket that are secured to a fixed structure, a pair of L-shaped box roller holders that are inserted within a guide of the L-shaped brackets, and a pair of screws that are inserted within a pair of threaded bores of the L-shaped brackets that allows a box shade roller to be adjusted when placed in the adjustable bracket system.

1 Claim, 5 Drawing Sheets

ADJUSTABLE BRACKET SYSTEM FOR A BOX SHADE ROLLER

BACKGROUND

The present invention is directed to an adjustable bracket system for a box shade roller.

Presently, box shade rollers are hung using fixed bracket systems.

Fixed bracket systems, once secured to a wall structure are impossible to adjust upwards or downwards.

The present inventor is an installer of box shade rollers. During the past year he has spent needless hours trying to align box shade rollers to look parallel to the roof or window wherein the box shade rollers are installed. One of the problems is not the leveling of the box shade rollers, the problem is that visually one does not realize that the structure wherein they are installed settle and therefore the box shade rollers appear to be unleveled.

Another problem is that not all bracket systems are bent the same way and that also leads to an appearance that the brackets where not secured correctly to wall structures.

The present invention uses an adjustable bracket system that allows an installer of box shade rollers to have a manner of adjusting a box shade roller upwards or downwards, incrementally, so that the box shade roller will have an appearance of being leveled after being installed.

The present invention provides a system that allows an installer to install box shade rollers efficiently and in a manner that will appears leveled to a user.

SUMMARY

The present invention is an adjustable bracket system that is used to secure a box shade roller to a fixed structure.

The adjustable bracket system comprises of a pair of L-shaped bracket that are secured to a fixed structure, a pair of L-shaped box roller holders that are inserted within a guide of the L-shaped brackets, and a pair of screws that are inserted within a pair of threaded bores of the L-shaped brackets that allows a box shade roller to be adjusted when placed in the adjustable bracket system.

An object of the present invention is to provide an adjustable bracket system for a box shade roller.

Another object of the present invention is to provide an adjustable bracket system that will allow installer to have flexibility when installing the brackets used to secure a box shade roller.

DRAWINGS

These and other features, aspects, and advantages of the present invention will become better understood with, regards to the following description, appended claims, and drawings where:

DESCRIPTION

Figure 1:
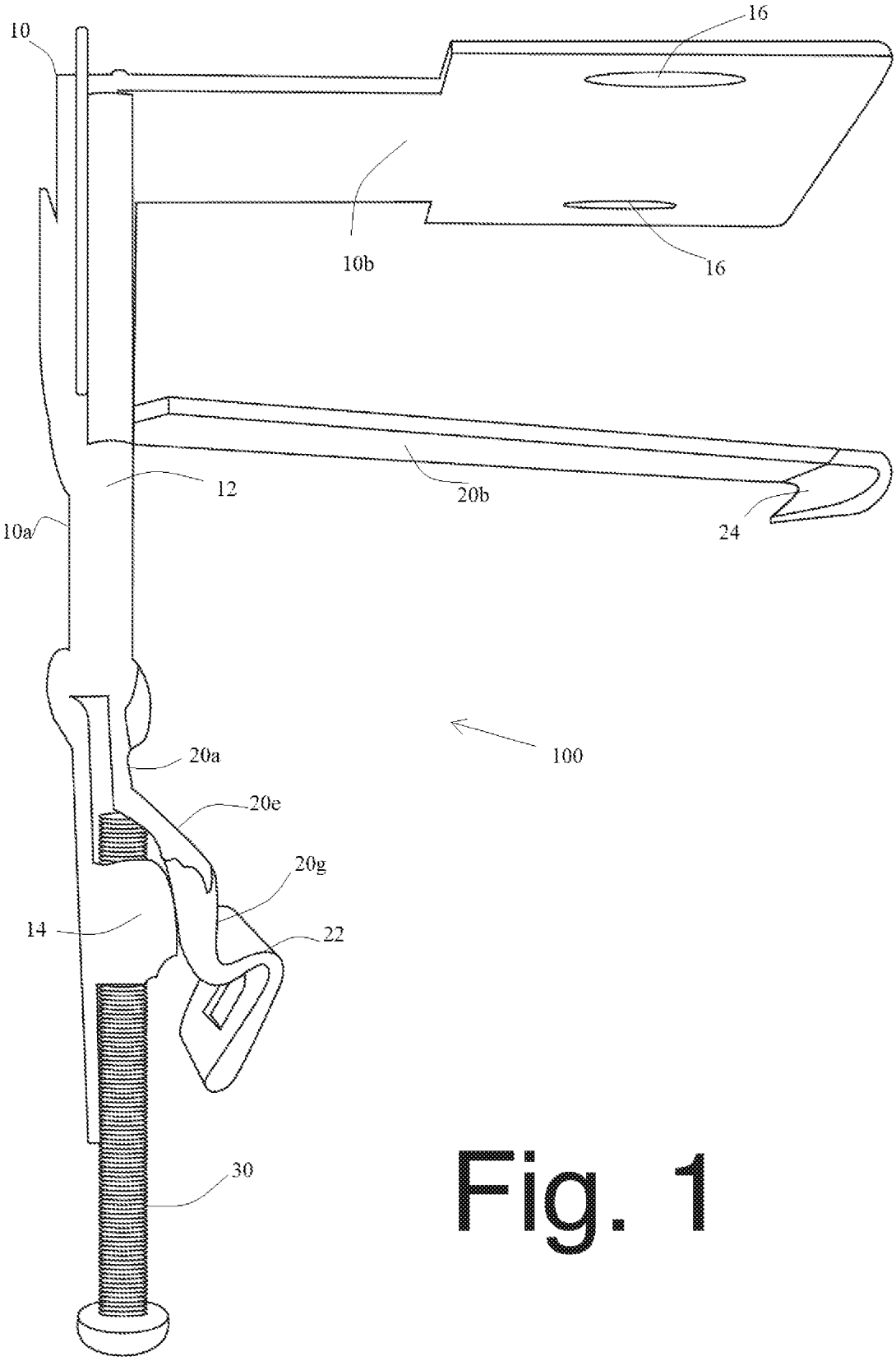
FIG. 1 shows a side view of an adjustable bracket system for a box shade roller.
Figure 2:
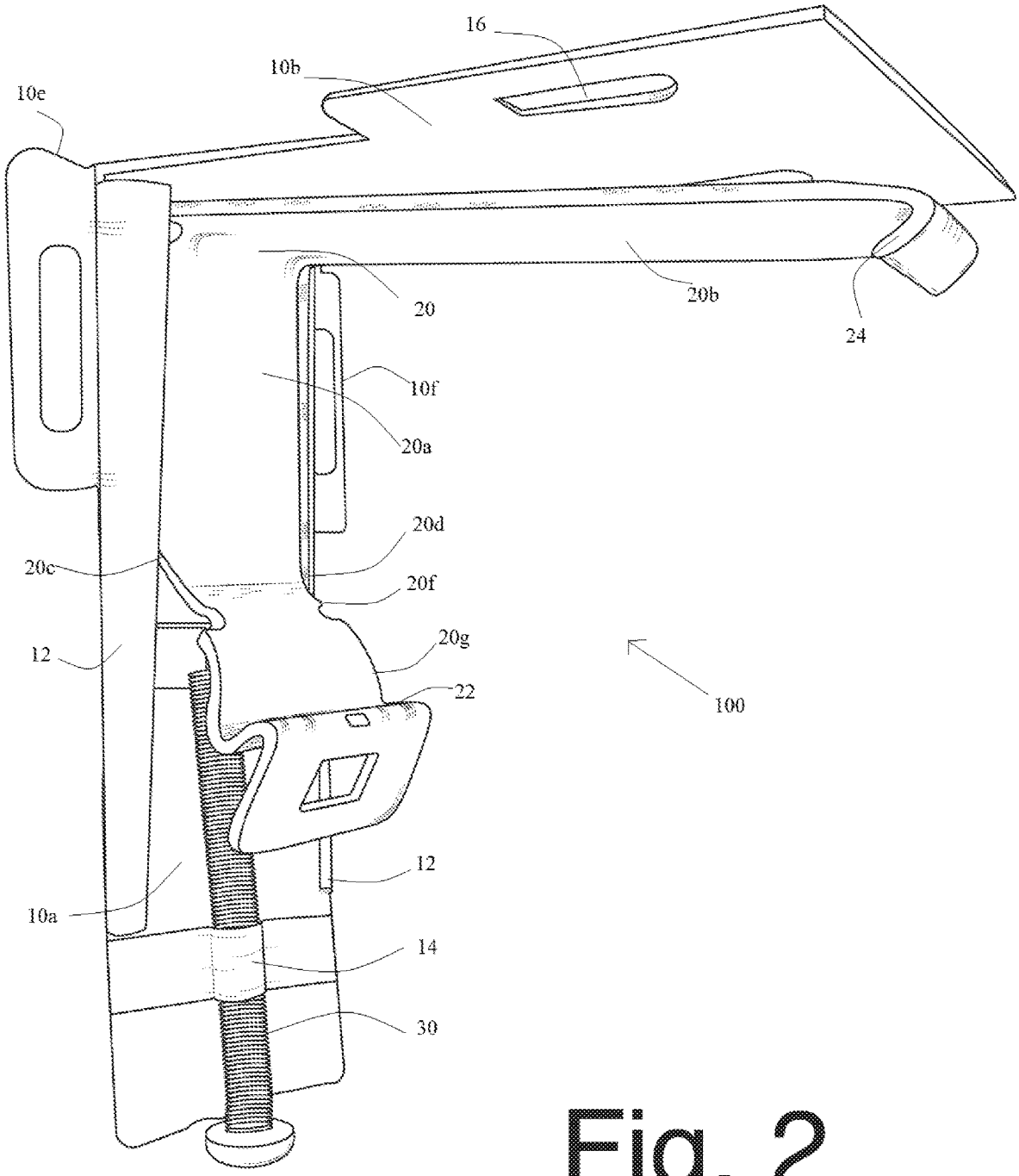
FIG. 2 shows a left perspective view of the adjustable bracket system.
Figure 3:
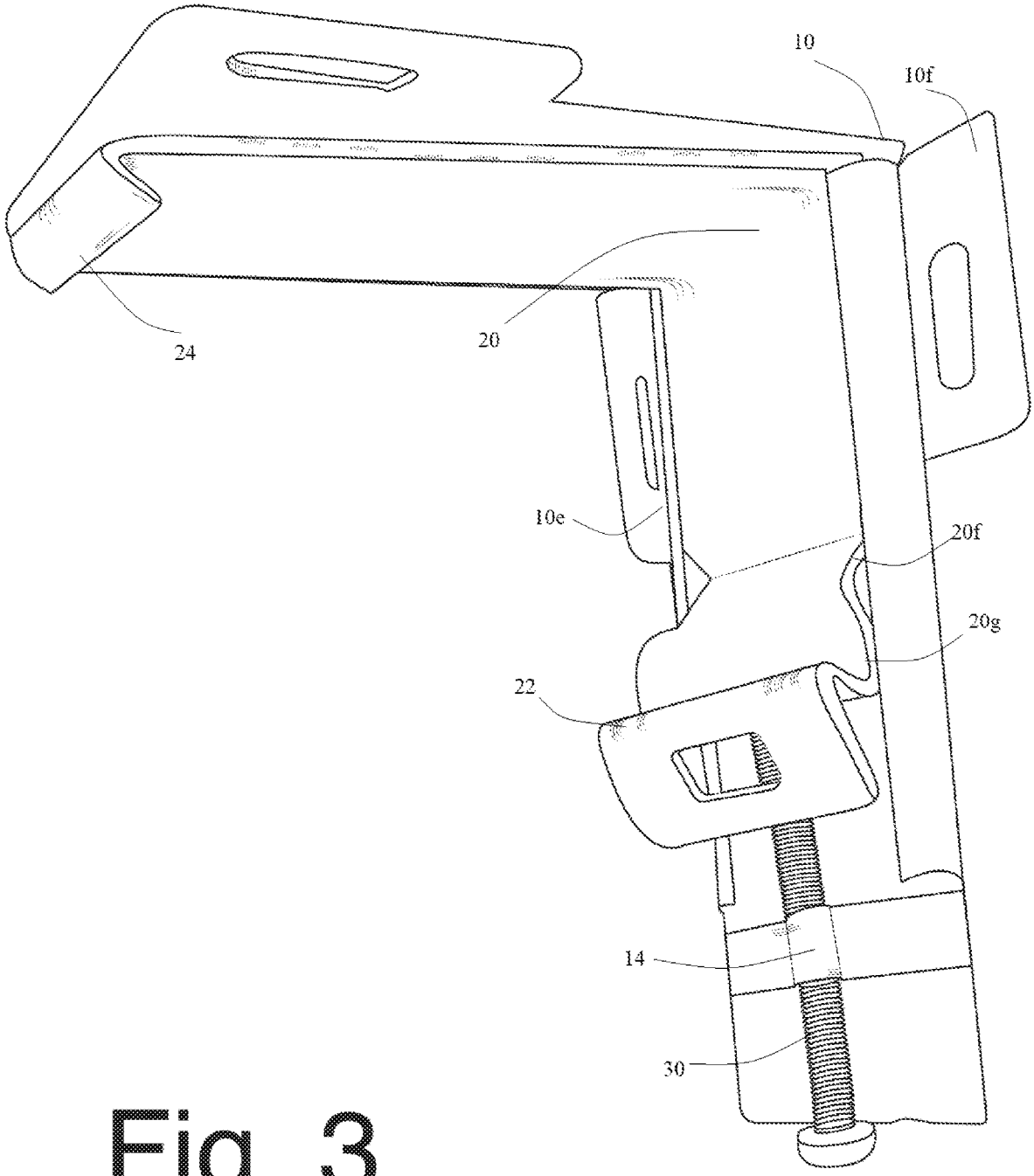
FIG. 3 shows a right perspective view of the adjustable bracket system.
Figure 4:
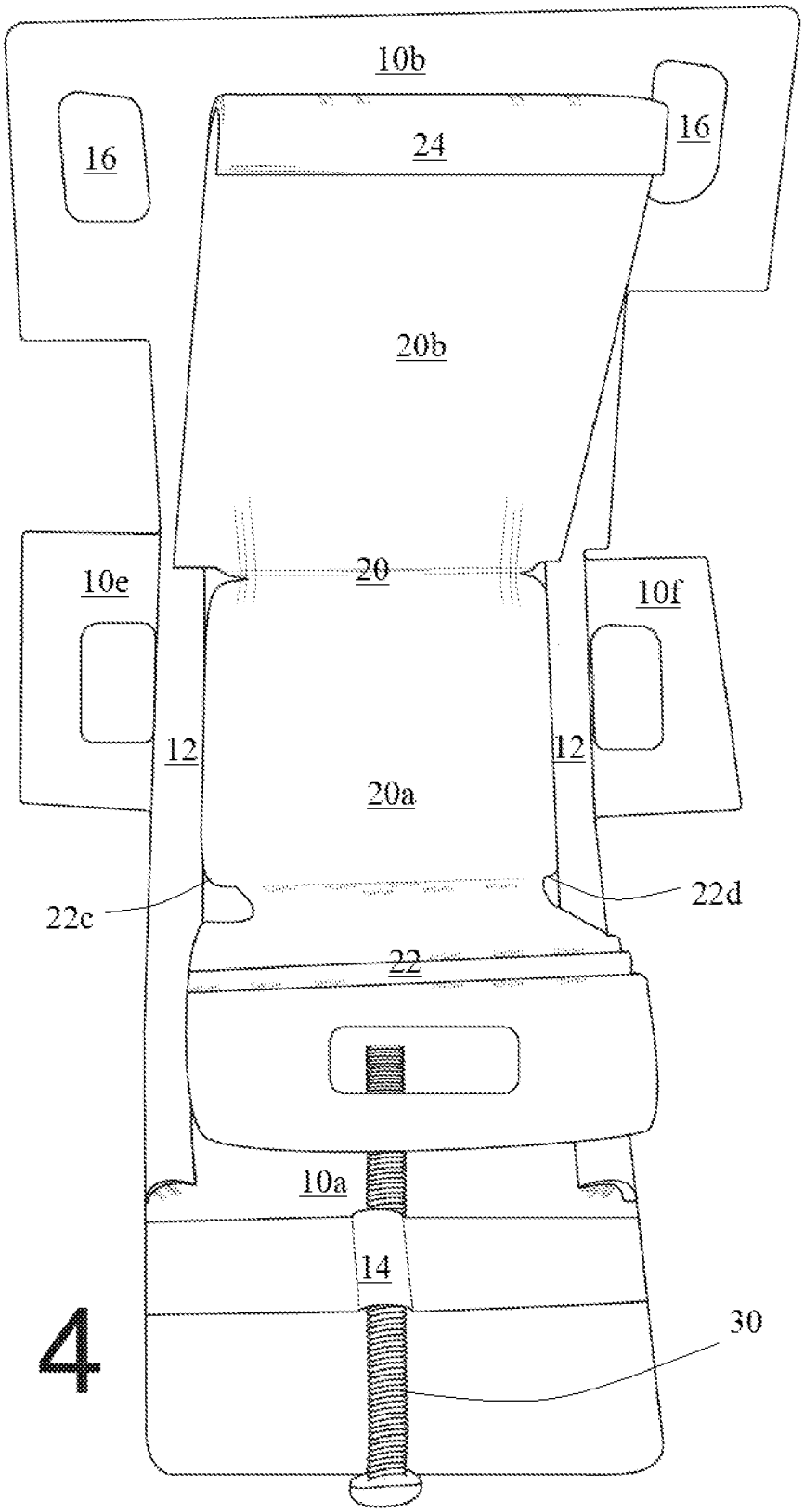
FIG. 4 shows a perspective front view of the adjustable bracket system.

As seen in FIGS. 1-5, the present invention is an adjustable bracket system for a box shade roller.

The adjustable bracket system 100 comprises of a pair of L-shaped brackets 10 that define a vertical part 10*a* and a horizontal part 10*b*, each vertical part has a left side 10*c* and a right side 10*d* and the left side 10*c* and the right side 10*d* of each vertical part 10*a* bend inward to form a guide 12, each vertical part 10*a* has a left wall attachment 10*e* guide and a right wall attachment guide 10*f*, and each vertical part 10*a* defines a threaded bore 14 that is located below each guide 12, each horizontal part 10*b* defines two through holes 16. A pair of L-shaped box shade roller holders 20, each L-shaped box shade roller holder 20 has a vertical 20*a* and a horizontal part 20*b*, each vertical part 20*a* has a left wing 20*c* and right wing 20*d* and a front side 20*e*, a section of each vertical part 20*f* is bent outward from the front side 20*e* and a lower section of 20*g* each vertical part 20*a* defines an upward curved section 22 that receives a box shade roller 200, each horizontal part 20*b* defines a hook 24 that hooks the box shade roller 200, the left wing 20*c* and the right wing 20*d* of each L-shaped box shade roller holder 20 insert within each guide 12 of each L-shaped bracket 10. And, a pair of screws 30 that are screwed on each threaded bore 14 of each L-shaped bracket 10.

Figure 5:
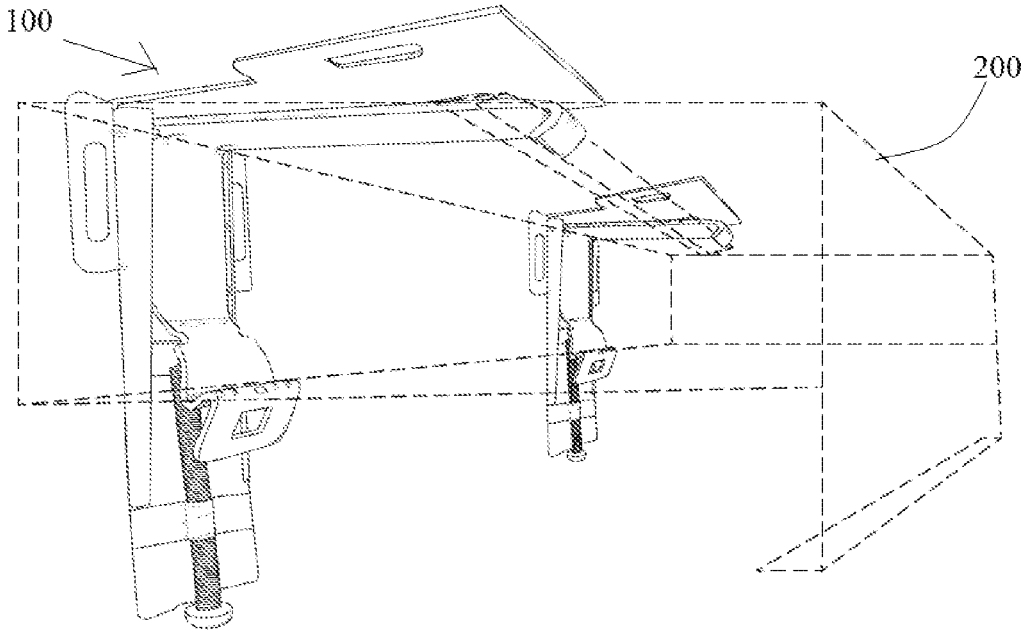
FIG. 5 shows a perspective vim of how a box shade roller is placed within the adjustable bracket system.

As seen in FIG. 5, the present invention is installed by first securing the adjustable bracket system 100 on to a wall or roof, then securing, a box shade roller 200 within two L-shaped box shade roller holders 20, and lastly adjusting the screws 30 so that the box shade roller 200 appears aligned to its surrounding structure.

An advantage of the present invention is that it provides an adjustable bracket system for a box shade roller.

Another advantage of the present invention is that it provides an adjustable bracket system that allows an installer to have flexibility when installing the brackets used to secure a box shade roller.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. An adjustable bracket system for a box shade roller, the adjustable bracket system comprises a pair of L-shaped brackets that define a vertical part and a horizontal part, each vertical part has a left side and a right side and the left side and the right side of each vertical part bend inward to form a guide, each vertical part has a left wall attachment guide and a right wall attachment guide, and each vertical part defines a threaded bore that is located below each guide, each horizontal part define two through holes;

a pair of L-shaped box shade roller holders, each L-shaped box shade roller holder has a vertical and a horizontal part, each vertical part has a left wing and a right wing and a front side, a section of each vertical part is bent outward from the front side and a lower section of each vertical part defines an upward curved section that receives a box shade roller, each horizontal part defines a hook that hooks the box shade roller, the left wing and the right wing of each L-shaped box shade roller holder insert within the guide of each L-shaped bracket; and a pair of screws, each screw is screwed on to each threaded bore of each L-shaped bracket.

* * * * *